US006311453B1

(12) United States Patent
Mechnick

(10) Patent No.: US 6,311,453 B1
(45) Date of Patent: Nov. 6, 2001

(54) FORM PIN CLIP

(76) Inventor: Theodore Mechnick, P.O. Box 1333, Pt. Pleasant, NJ (US) 08742

( * ) Notice: Subject to any disclaimer, the term of this patent is extended or adjusted under 35 U.S.C. 154(b) by 0 days.

(21) Appl. No.: 09/499,649

(22) Filed: Feb. 8, 2000

(51) Int. Cl.[7] ..... E04D 15/00

(52) U.S. Cl. ..... 52/749.1; 52/301; 52/678; 249/33; 72/101

(58) Field of Search ..... 52/677; 249/3, 249/4, 7

(56) References Cited

U.S. PATENT DOCUMENTS

| | | | | |
|---|---|---|---|---|
| 1,839,286 | * | 1/1932 | Wolf . | |
| 2,831,339 | * | 4/1958 | Jones | 72/101 |
| 5,301,485 | * | 4/1994 | Shaw et al. | 52/678 |
| 5,568,708 | * | 10/1996 | Kassardjian et al. | 52/301 |
| 5,670,076 | * | 9/1997 | Leek | 249/53 |

OTHER PUBLICATIONS

Reinforced Concrete, A Fundamental Approach, Third edition, Edward G. Nawy, 1996, Prentice Hall, 66.*

* cited by examiner

*Primary Examiner*—Carl D. Friedman
*Assistant Examiner*—Steve Varner
(74) *Attorney, Agent, or Firm*—Charles I. Brodsky

(57) ABSTRACT

For use in securing a concrete form board, the form pin of the invention includes a clip having first portion substantially in the shape of a cylinder to be forced onto one end of a steel bar driven into sand, shale or clay and of an inside diameter substantially equal to the diameter of the bar, along with a tab portion having a plurality of spaced apertures extending through opposing planar surfaces to receive nails or screws to be removably secured to the concrete form board, and with the tab portion extending outwardly of the cylindrical portion a distance to allow manual grasping thereof in freeing the steel bar from the ground. In a preferred embodiment of the invention, the steel bar consists of a rebar having a plurality of rims circumscribing its outer surface, in cooperating with the cylindrical portion of the clip in limiting spinning, or otherwise movement of the clip once forced upon the rebar for use, especially when the clip is constructed of a deformable plastic.

17 Claims, 3 Drawing Sheets

FIG. 2
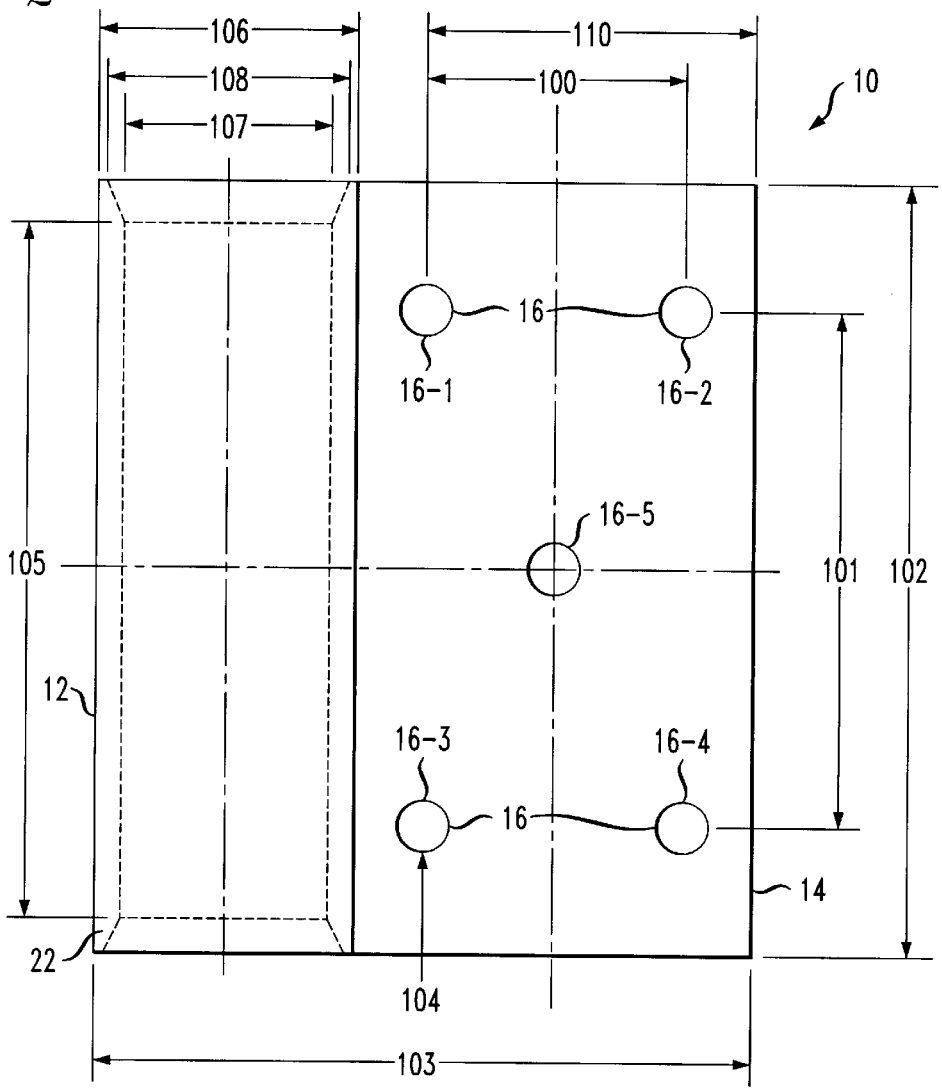
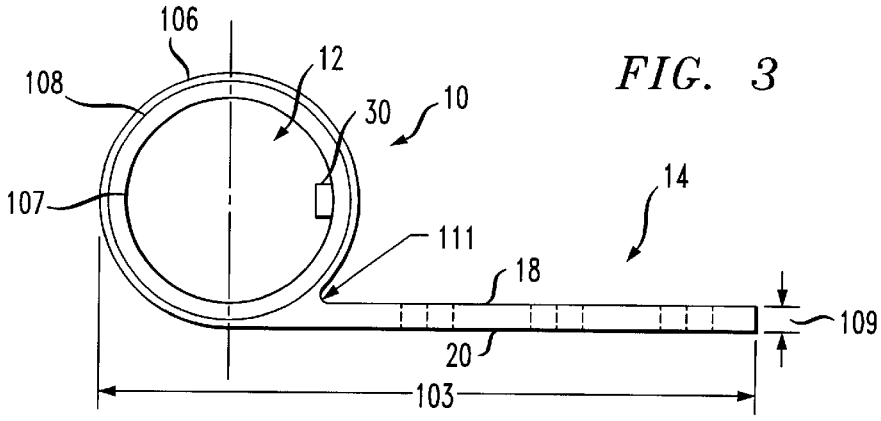
FIG. 3

FORM PIN CLIP

FIELD OF THE INVENTION

This invention relates to the pouring of concrete and, more particularly, to a pin employed in the fixing of form boards between which the concrete is poured.

BACKGROUND OF THE INVENTION

As is known in the concrete pouring business, various types of pins are generally employed in the fixing of the form board. For the small, independent construction contractor who only occasionally does concrete work, a wooden pin is generally made—of 5/4 lumber and whittled to a point, for example—for driving into the ground in setting the board. While sometimes adequate to do the job, pins of this type are not often used (and, because it takes some time and labor to point the lumber, and because it is quite difficult to drive the pin the required depth into the ground to fix the form board, especially where there is an extensive amount of clay and shale present).

A concrete contractor working in the business, on the other hand, utilizes a pin made of steel, with holes drilled through at random intervals, to be driven into the ground next to the form board, and to receive nails hammered through the holes and into the board. While being made of steel—and therefore easier to drive into clay, shale, and other hard surfaces—, such pins are fairly expensive (e.g. priced at some $2.65 for a 16 in. pin of ¾ in. diameter, and with a 24 in. pin costing that much more). Experience has shown that it is not uncommon for a concrete contractor to purchase 200 or so pins of this type at any one time, packaged 10 to a box; and it then becomes quite annoying, as well as quite costly, to find such pins being lost, or rendered unusable when the holes begin to fill with over-poured concrete and allowed to set—each as a result of shoddy workmanship at the jobsite. Because dirt is continually being knocked about at the job location, because the steel form pins are of a color similar to that of the dirt, and because the colorization of the concrete is not that very much different from that of the pins, the construction worker frequently forgets to retrieve the pins after the nails have been pulled from the form board when the concrete has set. What with the chaos of the ongoing pour, it is not unusual for the worker to forget the pin, leaving it behind—or to forget to clean out the concrete which accumulates in the holes of the pin.

Experience has further shown that while the typical concrete construction worker does not view the retrieval of these form pins for later use as a priority item, such matter represents a major concern in the concrete pouring business, being one of an unnecessary recurring expense.

SUMMARY OF THE INVENTION

As will become clear from the following description, a new and improved form pin, according to the invention, continues to use a steel bar of given diameter and length—but one which does not include any holes drilled through at random intervals. A clip is employed, instead, having a first portion substantially in the shape of a cylinder and a second portion substantially in the shape of a tab extending at an angle from an outside surface of the cylindrical portion along its length. As will be described, the cylindrical portion of the clip is constructed of an inside diameter substantially equal to the given diameter of the steel bar, and with the tab portion having a plurality of spaced apertures extending through opposing planar surfaces of the tab. In accordance with the invention, furthermore, the clip is constructed of a deformable plastic to expand when then forced onto one end of the steel bar—with or without an opposing end of the steel bar being cut at an angle towards a point.

Experience has further shown that at the concrete construction jobsite there are almost always available unused concrete reinforcing rods termed "rebars", of ⅜ in., ½ in., ⅝ in., and ¾ in. diameter of random lengths left over from an initial 20 ft. piece. Rather than throwing away these left-over pieces, the form pin of the invention utilizes the otherwise discarded rods, by cutting them to a 16 in., 24 in., or 32 in. length to serve as the steel bar of the form pin, being cut flush, substantially perpendicular to the length of the rebar at each end. As is known, such rebars incorporate a plurality of rims which circumscribe their outer surfaces.

According to the invention, the clip of the form pin is first selected of a color to contrast with that of the sand, shale or clay into which the steel bar is to be driven, and with the apertures of its tab portion being spaced, either as at the corners of a rectangle formed on the planar surfaces, or as spaced in the configuration of an X formed on such surfaces. To facilitate forcing the cylindrical portion of the clip onto the bar, both ends of the cylindrical portion are bevelled, a distance of the order of ⅛ in. To facilitate the removal of the form pin from the ground after the concrete has set, the tab portion of the clip extends outwardly from the cylindrical portion a distance to allow manual grasping by a user to twist the pin free. In a preferred embodiment of the invention, to be described, the cylindrical portion of the clip is selected of a length of substantially 3 in., while the tab extends outwardly a distance of substantially 1.5 in.

As will be described, the clip of the form pin is selected of a deformable plastic (such as polyethylene), for the cylindrical portion to be forced outwardly as the steel bar is hammered through the clip and into the ground. Such hammering serves to flatten the flush end of the bar in preventing the clip from loosening off the top—and when a rebar is employed, its circumscribing rims afford additional friction surfaces to hold the clip tight.

In another embodiment of the invention, the cylindrical portion of the clip will be seen to receive an O-ring, internal of the cylinder and of a deformable construction to groove under force of the rebar rims to further hold the clip secure and in place. When, for example, the clip is injection molded, the O-ring can be incorporated as part of the molding process, about ⅛ in. thick and positioned about ¼ in. in from either end of the cylindrical portion. Also, an additional flap can be included as part of the clip, internal of the cylindrical portion, and arranged to seat between adjacent ones of the rebar rims as the clip is hammered into position for use. Alternatively, a slot or hole can be cut into the cylindrical portion to accept a horseshoe clip or pressure pin to further hold the bar in place once inserted.

As will be appreciated by those skilled in the art, the clip of the invention becomes secure to the steel bar as the steel bar is hammered into the ground. With the clip fast in place, a cordless drill could then be employed to screw the combination to the form board, or it could be nailed instead. After the pouring process and the concrete sets, the screws are backed out—and the form pin removed by twisting and pulling upwardly on the tab portion or bar. Because of the contrasting colorization of the tab portion, the form pin will be readily identified and its retrieval can then follow easily.

BRIEF DESCRIPTION OF THE DRAWINGS

These and other features of the invention will be more clearly understood from a consideration of the following description, taken in connection with the accompanying drawings in which:

FIG. 2 is a machine drawing of a front view of the clip of FIG. 1, helpful in an understanding of its manufacture, with a rear view thereof understood to be a mirror image;

FIG. 3 is a machine drawing of a top view of such clip, its bottom view also being a mirror image;

DETAILED DESCRIPTION OF THE DRAWINGS

The clip of the form pin invention is shown at 10, of a deformable colorized plastic, such as polyethylene. The cylindrical portion of the clip 10 is shown at 12, while its tab portion is shown at 14. A plurality of apertures extend through the planar surfaces 18, 20 of the tab portion 14—either in the X-pattern illustrated, or as at the corners of a rectangle, with the intermediate aperture 16-5 being omitted. The distance between the apertures 16-1 and 16-2 (and between the apertures 16-3 and 16-4) is represented as 100, while the distance between the apertures 16-1, 16-2 and 16-3, 16-4 is shown at 101. The intermediate aperture 16-5 will be appreciated as being midway between the apertures 16-1 and 16-2 (and between the apertures 16-3 and 16-4), as well as being midway between the apertures 16-1, 16-2 and 16-3, 16-4. The overall height of the clip is shown at 102, the overall width is shown at 103 and the diameter of the several apertures is shown at 104.

Figure 4:
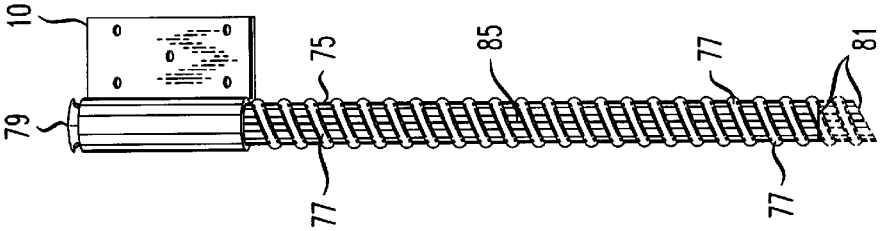
FIG. 4 illustrates the form pin clip forced onto a rebar type of steel bar according to a preferred embodiment of the invention.

The opposing ends of the cylindrical portion 12 are bevelled, as at 22, some ⅛ in., to provide an internal height for the cylinder shown at 105. The outer diameter of the cylindrical portion of the form pin clip is shown at 106, with its inside diameter being shown at 107. The diameter of the cylindrical portion 12 at the point where the bevel 22 begins is shown at 108. As will be appreciated, the dimension 107 is selected so as to form a tight fit with the steel bar onto which the clip 10 is hammered (75 in FIG. 4). Where a rebar having circumscribing rims 77 is employed as the steel bar, the dimension 107 is selected somewhat larger in order to accommodate (and deform outwardly from under the force of) the rims 77 as the clip is hammered down. The thickness of the tab portion between the planar surfaces 18 and 20 is shown at 109, while the positioning of the apertures 16-1 and 16-3 with respect to the edge of the tab portion 14 is illustrated at 110. As shown in FIG. 3, the tab portion 14 extends along a radius 111 from an outside surface of the cylindrical portion 12.

Figure 1:
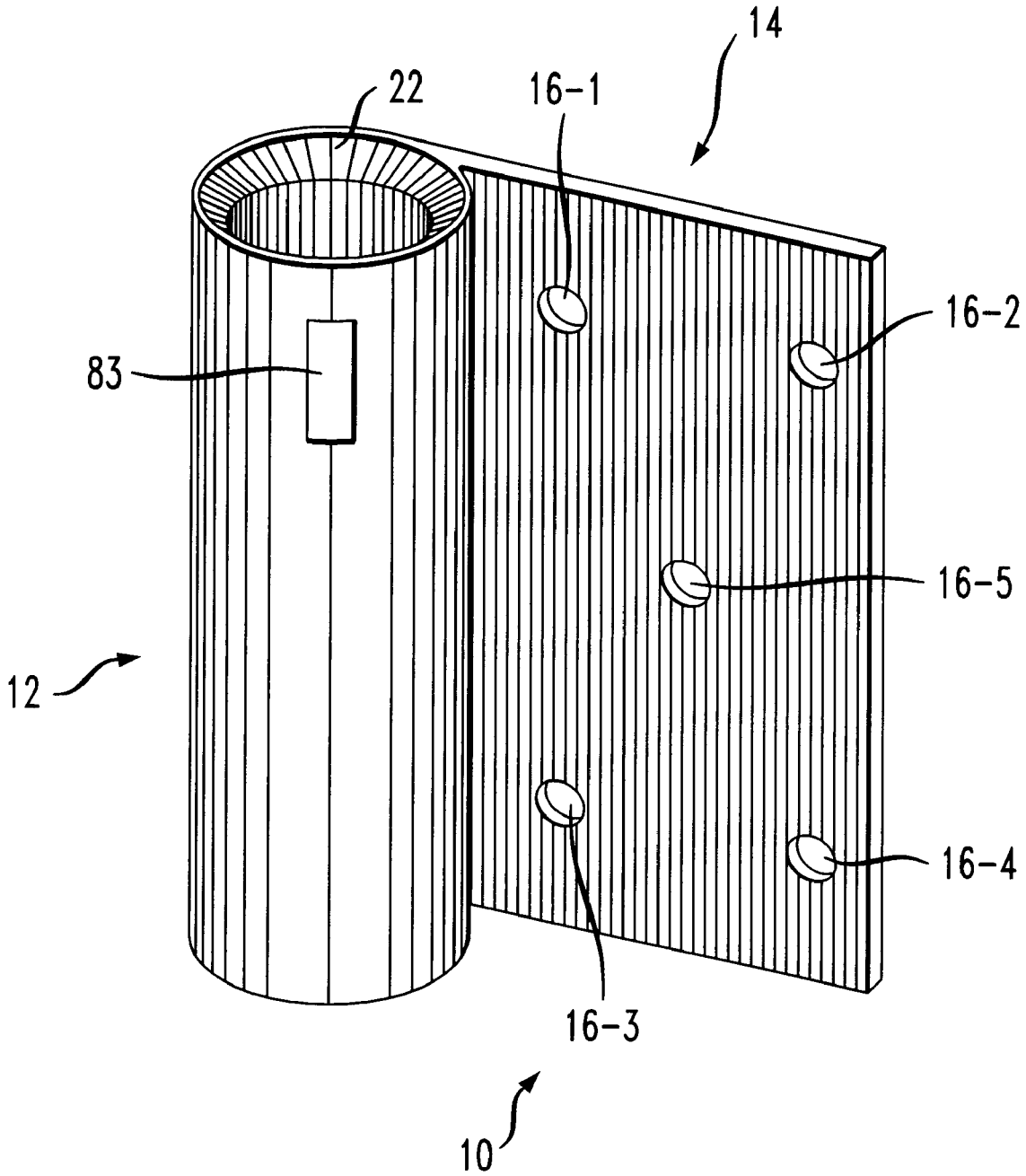
FIG. 1 is a perspective view of a form pin clip constructed in accordance with the invention.

To utilize the form pin of the invention, the clip of FIGS. 1–3 (injection molded, for example, to the shape depicted) is hammered or otherwise forced onto the steel bar 75. Such hammering flattens the top 79 of the bar 75 to prevent loosening of the clip 10 at that end, while the bottom 81 of the bar 75 may be cut at an angle to ease its being driven into the sand, shale, clay, etc. of the ground, or may be left flat for enhanced holding power. The steel bar 75 deforms the plastic cylindrical portion 12 outwardly in holding it in place—especially when a rebar is employed as the drive pin, the circumscribing ribs 77 then adding several instances of further frictional resistance.

As FIG. 3 illustrates, in accordance with the invention, an additional O-ring can be molded into the clip, as illustrated at 30. Extending inwardly a distance of some ⅛ in. or so, and positioned some ¼ in. in from the opposing bevelled ends 22, the O-ring 30 further deforms under action of a rib 85 in forming a groove to hold the clip 10 against the circumscribing rims 77 in preventing "spinning" of the clip 10 about the rebar 75. A deformable flap 83 on the cylindrical portion 12 (FIG. 1) can likewise seat between adjacent rims 77 as the clip 10 is forced onto the bar 75, in further limiting up-and-down movement of the clip 10 once it is placed in position.

Figure 5C:
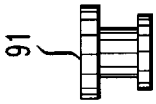
FIGS. 5*a*–5*c* are helpful in understanding another form pin clip carrying out the teaching of the invention.
Figure 5B:
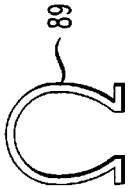
Figure 5A:
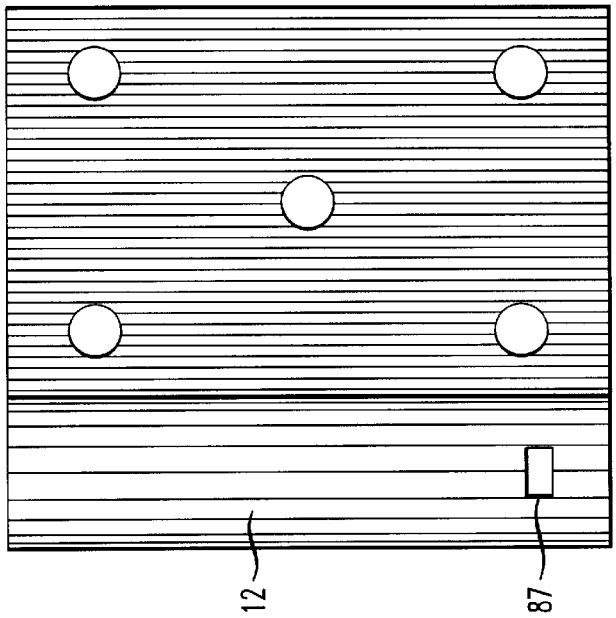

Alternatively, as shown in FIGS. 5*a*–5*c*, a slot or hole 87 can be cut in each side of the cylindrical portion 12, to accept either a horseshoe clip 89 or push-pin 91 (preferably of plastic) to hold or bear against the steel bar 75 in maintaining it secure.

As will be appreciated, a cordless drill can then be employed in screwing the clip 10 through the apertures 16-1 through 16-4 or 16-5, into the concrete form board (not shown), to be thereafter backed-off and removed after the poured concrete has set—or a nail-through process can be used to effect the securement. Once the clip 10 is thus freed, the tab portion 14 can be grasped by the user in loosening the form pin from the ground, to be thereafter retrieved, noting its contrasting colorization with the surrounding ground.

While Applicant does not wish to be limited to any particular set of values, the following have proven useful in a construction of the preferred embodiment of the invention.

| | |
|---|---|
| Dimension 100 | 1.00 in. |
| Dimension 101 | 2.00 in. |
| Dimension 102 | 3.00 in. |
| Dimension 103 | 2.50 in. |
| Dimension 104 | 0.188 in. diameter |
| Dimension 105 | 2.70 in. |
| Dimension 106 | 1.00 in. |
| Dimension 107 (for ¾ in. rebar) | 0.793 in. |
| Dimension 108 | 0.924 in. |
| Dimension 109 | 0.094 in. |
| Dimension 110 | 1.25 in. |
| Dimension 111 | 0.31 in. radius |

While there have been described what are considered to be preferred embodiments of the present invention, it will be readily appreciated that modifications can be made by those skilled in the art without departing from the teachings herein.

For at least such reason, therefore, resort should be had to the claims appended hereto for a true understanding of the scope of the invention.

I claim:

1. In a form pin securing a concrete form board in position on ground, the combination comprising:

a steel bar of given diameter and length; and a clip having a first portion substantially in the shape of a cylinder and a second portion substantially in the shape of a tab extending at an angle from an outside surface of said cylindrical portion along a length thereof;

with said cylindrical portion having an inside diameter substantially equal to said given diameter of said steel bar;

with said tab portion having a plurality of placed apertures extending through opposing planar surfaces of said tab portion;

with said clip being constructed of a deformable plastic to expand when forced onto one end of said steel bar;

wherein said steel bar consists of a rebar having a plurality of rims circumscribing an outer surface thereof;

wherein said one end of said steel bar is cut at an angle substantially perpendicular to the length of said bar;

and wherein an opposing end of said steel bar is driven into the ground next to said concrete form board in securing said form board in place.

2. The combination of claim 1 wherein said opposing end of said steel bar is cut at an angle towards a point.

3. The combination of claim 1 wherein said rebar is of a diameter of substantially ⅜, 1/2, 5/8 or ¾ inches.

4. The combination of claim 1 wherein said apertures of said tab portion are spaced as at the corners of a rectangle formed on said planar surfaces.

5. The combination of claim 1 wherein said apertures of said tab portion are spaced in the configuration of an X formed on said planar surfaces.

6. The combination of claim 1 wherein said cylindrical portion of said clip is inwardly bevelled at opposing ends thereof.

7. The combination of claim 6 wherein said cylindrical portion of said clip is inwardly bevelled a distance of the order of ⅛ inch.

8. The combination of claim 1 wherein said tab portion extends outwardly a distance to allow manual grasping in attempted freeing by a user from a ground position of said steel bar in sand, shale or clay.

9. The combination of claim 8 wherein said tab portion extends from said outside surface of said cylindrical portion a distance of substantially 1.5 inch.

10. The combination of claim 9 wherein said cylindrical portion is of a length of substantially 3 inch.

11. The combination of claim 10 wherein said clip is selected of a color different from that of the sand, shale or clay into which said steel bar is driven.

12. The combination of claim 1 wherein each of said one end of said steel bar and an opposing end thereof is cut at an angle substantially perpendicular to the length of said bar.

13. The combination of claim 1, also including an opening on said cylindrical portion for receiving a securement means to hold said rebar when forced into said clip.

14. The combination comprising:

a steel bar of given diameter and length; and a clip having a first portion substantially in the shape of a cylinder and a second portion substantially in the shape of a tab extending at an angle from an outside surface of said cylindrical portion along a length thereof;

with said cylindrical portion having an inside diameter substantially equal to said given diameter of said steel bar;

with said tab portion having a plurality of placed apertures extending through opposing planar surfaces of said tab portion; and with said clip being constructed of a deformable plastic to expand when forced onto one end of said steel bar;

wherein said steel bar consists of a rebar having a plurality of rims circumscribing an outer surface thereof; and an O-ring internal of said cylindrical portion, and deformable to groove by said rebar rims as said clip is forced onto said rebar.

15. The combination of claim 14 wherein said O-ring is positioned substantially ¼ inch in from opposing ends of said cylindrical portion.

16. The combination of claim 15 wherein said O-ring is of a thickness of the order of ⅛ inch.

17. The combination comprising:

a steel bar of given diameter and length; and a clip having a first portion substantially in the shape of a cylinder and a second portion substantially in the shape of a tab extending at an angle from an outside surface of said cylindrical portion along a length thereof;

with said cylindrical portion having an inside diameter substantially equal to said given diameter of said steel bar;

with said tab portion having a plurality of placed apertures extending through opposing planar surfaces of said tab portion; and with said clip being constructed of a deformable plastic to expand when forced onto one end of said steel bar;

wherein said steel bar consists of a rebar having a plurality of rims circumscribing an outer surface thereof; and a flap on said cylindrical portion along a portion of the length thereof, inwardly deformable to seat between adjacent ones of said rims as said clip is forced onto said rebar.

* * * * *